US006310587B1

(12) United States Patent
Villino et al.

(10) Patent No.: US 6,310,587 B1
(45) Date of Patent: Oct. 30, 2001

(54) ANTENNA FOR HIGH FREQUENCY RADIO SIGNAL TRANSMISSION

(75) Inventors: Guido Villino, Leonberg; Friedrich Landstorfer, München; Marcus Maier; Hans-Oliver Ruoss, both of Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,736

(22) PCT Filed: Mar. 3, 1998

(86) PCT No.: PCT/DE98/00615

§ 371 Date: Mar. 31, 2000

§ 102(e) Date: Mar. 31, 2000

(87) PCT Pub. No.: WO98/54788

PCT Pub. Date: Dec. 3, 1998

(30) Foreign Application Priority Data

May 30, 1997 (DE) ..... 197 22 547

(51) Int. Cl.[7] ..... H01Q 15/08
(52) U.S. Cl. ..... 343/911 R; 343/753
(58) Field of Search ..... 343/753, 755, 343/700 MS, 895, 911 L, 911 R

(56) References Cited

U.S. PATENT DOCUMENTS

| | | | | |
|---|---|---|---|---|
| 2,887,684 | * | 5/1959 | Dexter et al. | 343/911 R |
| 3,886,561 | | 5/1975 | Beyer | 343/911 R |
| 3,917,773 | | 11/1975 | Gates, Jr. et al. | 343/911 R |
| 4,179,699 | * | 12/1979 | Lunden | 343/911 R |
| 4,755,820 | * | 7/1988 | Backhouse et al. | 343/700 MS |
| 5,017,939 | | 5/1991 | Wu | 343/911 R |
| 5,121,129 | * | 6/1992 | Lee et al. | 343/753 |
| 5,154,973 | | 10/1992 | Imagawa et al. | 428/325 |
| 5,162,806 | | 11/1992 | Monser | 343/753 |
| 5,625,368 | * | 4/1997 | Howson et al. | 343/753 |

FOREIGN PATENT DOCUMENTS

| | | |
|---|---|---|
| 29 34 289 | 3/1980 | (DE) . |
| 195 30 065 | 1/1997 | (DE) . |
| 2 251 519 | 7/1992 | (GB) . |
| 03 010407 | 1/1991 | (JP) . |

OTHER PUBLICATIONS

Zimmerman, MMMCOM, Dresden "Investigations of Antennas for an Indoor Wideband Communication System at 60 GHz" May 12–13, 1997**.

* cited by examiner

*Primary Examiner*—Tan Ho
(74) *Attorney, Agent, or Firm*—Kenyon & Kenyon

(57) ABSTRACT

An antenna for radiating high-frequency signals in an indoor space, the radiation cone being defined by a dielectric lens around the primary radiator. The dielectric lens includes an inner shell which is tailored to the indoor space and a hemispherical outer shell.

17 Claims, 1 Drawing Sheet

ANTENNA FOR HIGH FREQUENCY RADIO SIGNAL TRANSMISSION

BACKGROUND OF THE INVENTION

According to the article "Investigations of antennas for an indoor wideband communication system at 60 GHz," Zimmermann, MMMCOM, Dresden, 12–13 May 1997, it is known that an antenna for communication between a base station and a plurality of mobile stations in an indoor space may be designed as a lens antenna. The goal of this antenna is to set up radio links from a base station arranged beneath the ceiling to a plurality of mobile stations located in an indoor space, as part of a system for high-bit-rate data transmission in the 60 GHz frequency range. Using the antenna, the base station's high-frequency signal, which is present at the antenna's input, is radiated into the space for which coverage is to be provided. Thanks to the antenna's radiation pattern, even coverage can be provided over the entire indoor space at a defined working height. Among other things, greater transmitting power is supplied to the more distant mobile stations than to the mobile stations that are in close proximity beneath the transmitting antenna. The power level of the signal directed exactly perpendicular to the floor is lower than that of the signal radiated against the boundary walls of the indoor space. When a signal is transmitted between the base station and a given mobile station, reflections are avoided thanks to multipath propagation. Otherwise, individual waves are superimposed on one another at the receiving location, so that total field intensity may be lost entirely due to interference, depending on the phase position. The proposed antenna for radiating the high-frequency signal from the base station includes a lens-shaped plexiglass shaped element fed by a waveguide. The geometry of the outer shell of the lens is tailored to the characteristics of the indoor space for which high-frequency signal coverage is to be provided. The radio signals which are radiated are linear polarized. Due to the geometry of the lens's outer shell, reflection losses occur during the transition from the lens material to the air. In addition, the antennas of the mobile participating units must be oriented so that they receive the linear polarized signals in a suitable manner.

SUMMARY OF THE INVENTION

By contrast, the antenna according to the present invention has the advantage that the geometry of the dielectric lens's inner shell is tailored to the indoor space, while the outer shell includes a hemisphere. As a result it is easier to apply an anti-reflection layer and to avoid reflection losses during the transition from the lens material to the air.

By using a primary radiator which includes a waveguide having a helix antenna, one can create lenses having a lower and having small dimensions. For example, this allows one to use polyethylene as the lens material. One can also achieve this advantage if the primary radiator includes a waveguide having a patch antenna.

Using a primary radiator of this kind has the advantage that the radio signals can be rendered circularly polarized. As a result, the antennas of the mobile stations no longer need to be oriented in a particular direction. In addition, using circularly polarized radio signals diminishes the effects associated with multipath propagation. Thus one can minimize interference effects. It is advantageous if the electric lens includes suitable antireflection features. To this end, it is advantageous if a $\lambda/4$ layer made of a suitable dielectric is applied or achieved via grooves.

DETAILED DESCRIPTION

Figure 1:
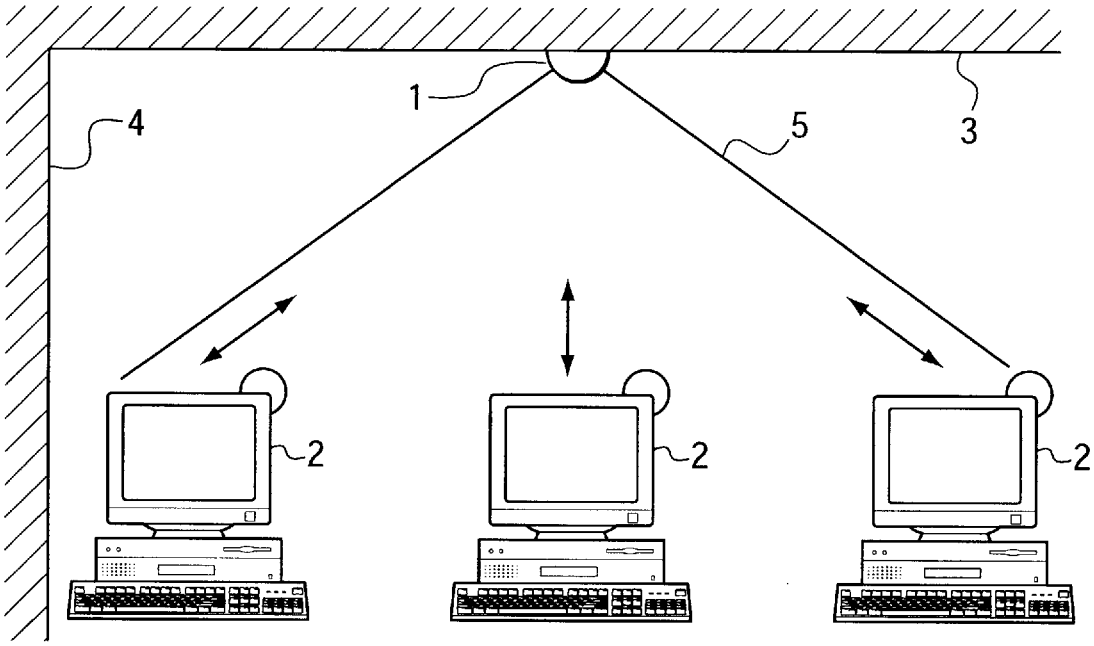
FIG. 1 shows the communication system.

FIG. 1 shows a base station 1 and a plurality of mobile stations 2, which communicate with one another via radio signals. Mobile stations 2 are located in an indoor space, the boundaries of which are formed by a wall 4 and a ceiling 3. The radio signals radiated by the base station are formed so as to give radiation cone 5. Note that the radiation cone is formed so that as far as possible reflections on wall 4 are avoided. Transmitting power varies within the radiation cone: it is higher on the cone's surface, so that the more distant mobile stations can be supplied with transmitting power, and lower in the middle of the radiation cone.

Figure 2:
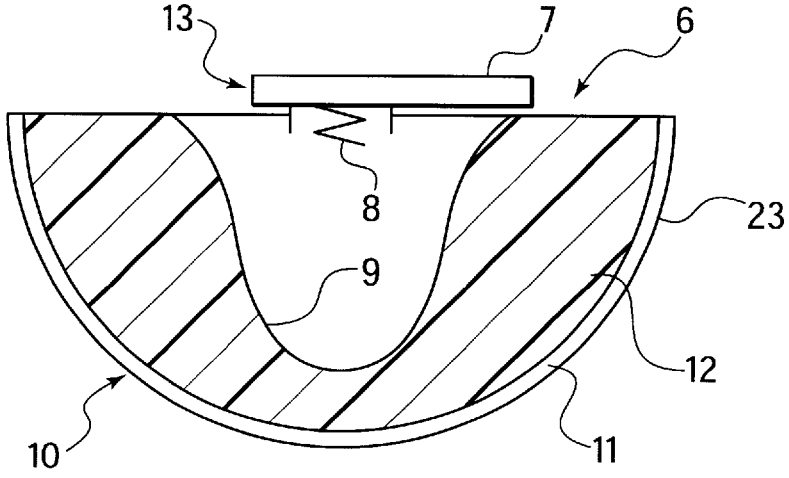
FIG. 2 shows the antenna according to the present invention.

FIG. 2 shows antenna 6 according to the present invention, which includes a primary radiator 13 and a dielectric lens 12. Primary radiator 13 includes a waveguide 7, on which a helix antenna or patch antenna 8 is arranged. The primary radiator protrudes into the inner shell of dielectric lens 12. Outer shell 10 of dielectric lens 12 is hemispherical in shape. Anti-reflection layer 11 is located on the hemispherical surface of outer shell 10.

The antenna of the base station includes a primary radiator and the dielectric lens. Primary radiator 13 is excited directly by the waveguide, and as a result no transitions or additional interfaces are required. The primary radiator generates a 60°-wide radiated field pattern having circular polarization which is formed by dielectric lens 12 so as to give the desired pattern. The shape of the dielectric lens is based on the spatial geometry and can be tailored to any indoor space. As the outer and the inner shell of the lens can be used for beamforming, there are two degrees of freedom. To ensure that one can implement the simple anti-reflection layer, the wavefronts of a high-frequency signal must be as parallel to the lens surface as possible when they issue from the material of outer shell 10. Hemispherical geometry is therefore used for the outer shell. Inner, rotationally symmetrical shell 9 can be tailored to different indoor spaces. The lens itself is made from dielectric material that is easy to manufacture. For example, one may use polyethylene for which $\epsilon_r$=2.14. Symmetrical grooves 23 are milled into the material of the lens as the $\lambda/4$ antireflection layer for the dielectric-air transition. These grooves must be smaller than the wavelength in the substrate. One can achieve a simple anti-reflection layer by using grooves of this kind having a suitable depth in conjunction with a suitable pulse-duty ratio, and as a result no additional coating is required. For example, given a pulse-duty ratio of 1:1, 0.5-mm-wide, 1-mm-deep grooves are cut into the lens. As a result, reflection losses are avoided and the antenna's efficacy is improved. In addition, the antenna's radiation pattern is flattened.

What is claimed is:

1. An antenna for radiating high-frequency radio signals in an indoor space, comprising:

a primary radiator; and a dielectric lens surrounding the primary radiator, the dielectric lens defining a radiation cone, the dielectric lens including an inner shell and a hemispherical outer shell, the inner shell being tailored to dimensions of the indoor space.

2. The antenna according to claim 1, wherein the dielectric lens includes polyethylene.

3. The antenna according to claim 1, wherein the outer shell has a dielectric coating.

4. The antenna according to claim 1, wherein the primary radiator includes a waveguide having a helix antenna.

5. The antenna according to claim 1, wherein the primary radiator includes a waveguide having a patch antenna.

6. The antenna according to claim 1, wherein the primary radiator includes a waveguide.

7. The antenna according to claim 1, wherein the radio signals are circularly polarized.

8. The antenna according to claim 1, wherein the outer shell has grooves.

9. The antenna according to claim 1, wherein the outer shell has grooves, and wherein the grooves are smallerthan the wavelength in a substrate secured to the lens.

10. The antenna according to claim 1, wherein the outer shell has grooves, and wherein the grooves are 0.5 mm wide and 1.0 mm deep.

11. The antenna according to claim 1, wherein the antenna is in direct communication with a mobile station.

12. The antenna according to claim 1, wherein the antenna is located on the ceiling of the indoor space.

13. The antenna according to claim 1, wherein data transmission from the antenna is at 60 GHz frequency.

14. The antenna according to claim 1, wherein transmitting power supplied to a distant mobile station is different than the transmitting power supplied to a closer mobile station.

15. The antenna according to claim 1, wherein the primary radiator protrudes into the dielectric lens.

16. The antenna according to claim 1, wherein the dielectric lens has $\epsilon_r$=2.14.

17. An antenna for radiating high-frequency radio signals in an indoor space, comprising:

a primary radiator; and a dielectric lens surrounding the primary radiator, the dielectric lens hemispherical outer shell, the inner shell being tailored to dimensions of the indoor space, wherein the outer shell has rotationally symmetrical grooves which form a $\lambda/4$ layer.

* * * * *